United States Patent [19]

Dibrell

[11] Patent Number: 4,520,632

[45] Date of Patent: Jun. 4, 1985

[54] METHOD AND APPARATUS FOR EXTRACTING HEAT AND MECHANICAL ENERGY FROM A PRESSURED GAS

[75] Inventor: Edwin W. Dibrell, San Antonio, Tex.

[73] Assignee: Centrifugal Piston Expander, Inc., San Antonio, Tex.

[21] Appl. No.: 524,281

[22] Filed: Aug. 19, 1983

Related U.S. Application Data

[63] Continuation-in-part of Ser. No. 436,852, Oct. 25, 1982, abandoned.

[51] Int. Cl.[3] ..... F25D 9/00

[52] U.S. Cl. ..... 62/403; 62/467; 62/499; 165/86

[58] Field of Search ..... 62/86, 403, 467 R, 499; 165/86

[56] References Cited

U.S. PATENT DOCUMENTS

| | | | |
|---|---|---|---|
| 1,323,785 | 12/1929 | Nichol | 62/403 |
| 1,511,985 | 10/1924 | Spencer | 62/403 |
| 2,174,584 | 10/1939 | Imus | 62/136 |
| 2,175,162 | 10/1939 | Waterfill | 62/136 |
| 2,716,971 | 9/1955 | Sykes | 123/46 |
| 2,730,874 | 1/1956 | Schelp | 62/402 |
| 3,052,106 | 9/1962 | Sanpietroetal | 62/402 |
| 3,648,670 | 3/1972 | Siddons | 123/43 R |
| 3,896,632 | 7/1975 | Huntley | 62/88 |
| 4,022,032 | 5/1977 | Nott | 62/499 |
| 4,197,715 | 4/1980 | Faucett | 62/467 R |

*Primary Examiner*—Ronald C. Capossela

*Attorney, Agent, or Firm*—Norvell & Associates

[57] ABSTRACT

The disclosure provides a rotating cylinder defining an elongated S-shaped fluid pressure chamber having the two ends thereof remotely located with respect to the axis of rotation. The S-shaped fluid pressure chamber accommodates a free piston which reciprocates along the length of the chamber according to fluid pressure and centrifugal forces applied thereto. Solenoid operated inlet and exhaust valves are provided at each end of the S-shaped fluid pressure chamber, and sensing devices, responsive to the passage of the free piston therethrough are disposed on opposite ends of the S-shaped fluid pressure chamber and adjacent the medial portions thereof to control the operation of the inlet and exhaust valves in accordance with the desired objective to either maximize the extraction of mechanical energy from a pressured gas or maximize the expansion of the pressured gas to derive the greatest possible cooling effect therefrom.

44 Claims, 7 Drawing Figures

METHOD AND APPARATUS FOR EXTRACTING HEAT AND MECHANICAL ENERGY FROM A PRESSURED GAS

RELATIONSHIP TO OTHER PENDING APPLICATIONS

This application constitutes a continuation-in-part of my co-pending application, Ser. No. 436,852, filed Oct. 25, 1982, now abandoned.

BACKGROUND OF THE INVENTION

1. Field of the Invention

The invention relates to a method and apparatus for efficiently extracting heat and mechanical energy from a pressured gas by expanding same in a rotating fluid pressure chamber.

2. Description of the Prior Art

In the co-pending application of James. G. Adams, Ser. No. 343,240, filed Jan. 28, 1982, now abandoned, there is disclosed a prime mover for an air conditioning system which allegedly involves the extraction of both heat and mechanical energy from a pressured refrigerant gas through the non-combustible expansion of such gas in a piston and cylinder assembly wherein the piston and cylinder are linearly relatively movable with respect to each other. Such piston and cylinder assemblies are mounted on a rotating supporting body and positioned on such body so that the path of relative linear movement of the piston and cylinder elements is disposed in a plane substantially normal to the axis of rotation and is radially displaced from the axis of rotation. Such location of the piston and cylinder elements effects displacement of the movable one of such elements to a radially outward position as a consequence of centrifugal force generated by the rotation of the piston and cylinder assembly by the rotation body. A charge of pressured gas is introduced into the piston and cylinder assembly so as to cause a relative movement of the piston and cylinder elements in a direction in opposition to the centrifugal forces acting thereon. The gas pressure reaction force allegedly assists in driving the rotating body, while the concurrent expansion of the pressured gas results in a substantial cooling of the confined body of pressured gas. Hence, the movable one of the piston and cylinder elements assumes a radially inner position at which point exhaust ports are traversed by the piston, permitting the expanded and cooled gas to be exhausted in a chamber defined by an enclosure shell which surrounds the rotating body and the piston and cylinder assemblage.

The apparatus disclosed in the aforementioned James G. Adams application then proposed to effect a compression of the expanded and cooled gas through the centrifugal action of the rotating chamber within which such cooled gas was discharged. Further experimentation has revealed the fact that excessively high rotational speeds of such rotating chamber would be required to effect the condensation of the cooled gas solely by centrifugal force. At the same time, the higher the rotational speed of the rotating body, the higher the pressure of the gas that must be supplied to the cooperating piston and cylinder elements in order to effect displacement of such elements against the ever increasing centrifugal forces.

In such prior art apparatus, a connecting rod has been secured to each of the piston elements, and such connecting rods were in turn respectively connected to rocker arms provided on a hub which was rotatable about the axis of the rotating body carrying the piston and cylinder elements. Additionally, each cylinder had to be pivotally mounted on the rotating body. The oscillating movement of the hub imparted by the piston connecting rods was employed to operate control valves for supplying pressured fluid to, or removing cooled expended gas from the cylinder chambers. Such connecting rod, hub mechanism and cylinder pivot mountings constituted expensive items to fabricate and maintain.

More importantly, a technical analysis of the apparatus disclosed in the aforementioned ADAMS application revealed that such apparatus could not extract mechanical energy from the pressured gas supplied to the apparatus, if it was desired to use the apparatus as a fluid pressure driven motor. While the rotational speed of the rotating cylinders is temporarily increased during the inward gas expansion movement of the cooperating pistons, an almost identical decrease in speed of rotation occurs when the pistons return to their outermost position. Thus, no net transfer of mechanical energy from the pressured gas actually resulted from a complete cycle of piston movement.

SUMMARY OF THE INVENTION

This invention provides one or more S-shaped cylinder elements mounted on a body for rotation about an axis wherein the cylinder elements define a path for oscillating movements of a cooperating free piston which extends from a point remote from the axis of rotation to a position proximate to or through the axis of rotation, and then to a point remote from the point of rotation and generally diametrically opposed to the other remote position. Thus, the free piston elements are reciprocated from one to the other of the radially outermost ends of their paths of movement.

The external contour of the piston is selected to permit the sliding, yet sealing movement of the piston along the entire length of the S-shaped cylinder. Thus, pistons in the shape of balls, ellipsoids, or other appropriate shape are employed having an external coating of a durable organic lubricating and sealing material.

The present invention employs longitudinally curved cylinders to define a fluid pressure chamber of generally S-shaped configuration, extending from one periphery of a rotating body inwardly through or proximate to the axis of rotation, and then extending outwardly to a diametrically opposed outer portion of the rotating body. In a preferred embodiment of the invention, the curvature of the S-shaped cylinder is designed so that the two ends of such cylinder extend generally in the direction of rotation and the end walls of such cylinder are respectively disposed in a generally radial plane with respect to the axis of the rotating body on which the cylinder is mounted. This permits the reaction force produced by the expanding pressured gas introduced into the cylinder to apply a maximum torque to aid in maintaining or increasing the rotational speed of the rotating body. A pair of solenoid operated inlet valves for pressured gas and a pair of solenoid operated exhaust valves for expanded gas are respectively mounted in each end of the S-shaped cylinder.

With this arrangement, the loss of rotational velocity and mechanical energy previously encountered during the return outward movement of the piston of the ADAMS device to its starting position is overcome by the fact that the fluid pressure may be maintained on the other face of the piston during such return movement, thus maintaining a reaction force on the end wall of the remote end of the S-shaped cylinder during each transverse movement of the piston without complete reliance on centrifugal force to return the piston to its original position.

When the cylinders are constructed with an S-shaped configuration in accordance with this invention, the inlet valve at the end of the cylinder to which the piston is approaching may be opened in advance of the piston reaching there and the piston brought to a cushioned stop by the fluid pressure thus introduced, further increasing the fluid pressure. More importantly, the reaction force on the cylinder resulting from stopping the free piston, which has made a full traverse of the S-shaped fluid pressure chamber, is in the correct direction to aid in increasing the velocity of the rotating S-shaped cylinder. Further, the piston may be brought to a cushioned stop by the fluid pressure which remains in cylinder in advance of the approaching piston, which is the residue fluid remaining unexhausted from prior expansion or power stroke of the device, and the energy of the piston is transferred to such gas to increase its pressure against the cylinder head which it is approaching to increase the rotational velocity of the cylinder. The energy of the piston will thus assist in accelerating the piston on its return motion through the cylinder after it has been brought to a cushioned stop. Thus, an apparatus incorporating one or more S-shaped rotating cylinders and cooperating free pistons can efficiently produce mechanical energy from a source of pressured gas, while at the same time, producing an expansion and cooling of the pressured gas supplied to it.

A further feature of the instant invention is the provision of electronic sensing devices positioned along the path of movement of the free piston element through the S-shaped cylinders to control the operation of the inlet and exhaust valves. Such sensing device, which may comprise either electro-magnetic or electrostatic pickup coils are disposed along the length of the S-shaped cylinder to respectively generate a signal indicating when the piston has arrived at a certain point in the S-shaped cylinder and utilizing such signal to effect the operation of either a pressured gas inlet valve or expanded gas outlet valve. In the preferred embodiment of the invention, four such pickup coils are employed, two of which are located adjacent the outer extremities of the S-shaped cylinder to detect when the free piston arrives at either of the outer extremities of the cylinder under the influence of centrifugal force generated by the rotation of the S-shaped cylinder by the rotating body. Such outermost sensing units effect a closing of the adjacent expanded gas exhaust valve and the opening of the adjacent pressured gas inlet valve as the free piston approaches the respective outer extremity of the S-shaped cylinder. Concurrently, the expanded gas exhaust valve at the opposite end of the S-shaped cylinder is opened to drive out the previously expanded gas so that the free piston is driven radially inwardly along the S-shaped path defined by the S-shaped cylinder by the charge of pressured gas, and such movement is opposed solely by centrifugal forces. To achieve a large reaction force on the S-shaped cylinder, and thereby achieve maximum driving torque on the rotating body, the pressured gas is applied until the free piston almost reaches the opposite end of the S-shaped cylinder.

To function as a cooling apparatus, two additional sensing devices are provided along medial portions of the S-shaped cylinder which respectively generate signals dependent upon the direction of movement of the free piston past such pickup devices. Such signals are caused to close the pressured gas input valves, thus, trapping a charge of pressured gas as the free piston moves outwardly to the other end of the S-shaped cylinder and producing an expansion of the pressured gas trapped in the chamber behind it. This expanded gas is then discharged through the opened exhaust valve when the piston makes its return stroke from the opposite extreme end of the S-shaped cylinder. The inlet valve at the end of the cylinder to which the piston approaches on its initial expansion stroke is opened and the exhaust valve closed prior to the piston reaching the end of the cylinder. This provides a cushion of pressured gas to arrest the movement of the piston and, at the same time, provides a reaction force on the end of the cylinder in the correct direction to increase the velocity of the rotating cylinder. The other central sensing device is responsive to the return movement of the free piston to perform exactly the same control operation as the first mentioned central sensing device, but on the valves at the opposite ends of the S-shaped cylinder.

Thus, the free piston becomes double acting, and extracts heat and mechanical energy from a pressured gas in both directions of its reciprocating movement in the S-shaped fluid pressure chamber and without complete dependence on centrifugal force to return the piston to the starting point.

Obviously, a plurality of such S-shaped cylinders may be employed on a single shaft. Pairs of such cylinders may be mounted on opposite sides of a rotatable body in the form of a disc and a plurality of such discs may be secured to the rotating shaft in axially spaced relationship. Thus, either the driving force imparted from the compressed gas may be optimized, or the degree of expansion, hence, cooling of the pressured gas, may be optimized depending upon the positioning of the aforementioned piston sensing devices.

Further objects and advantages of the invention will be readily apparent to those skilled in the art from the following detailed description, taken in conjunction with the annexed sheets of drawings, on which is shown the preferred embodiments of the invention.

DESCRIPTION OF THE PREFERRED EMBODIMENTS

Figure 1:
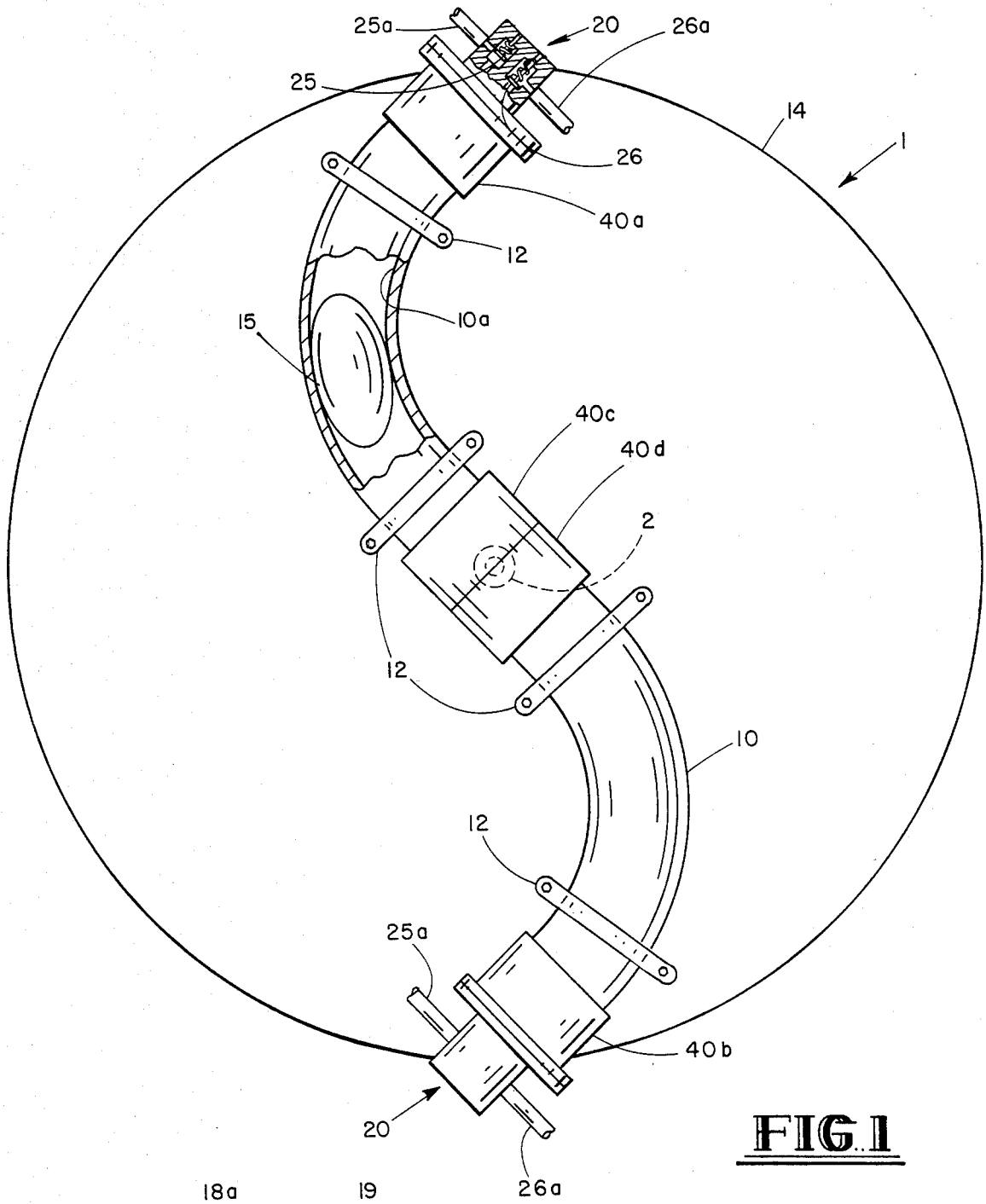
FIG. 1 is a schematic, elevational view of an apparatus embodying this invention utilizing a single cylinder element defining an elongated, S-shaped fluid pressure chamber.

In my co-pending application Ser. No. 436,412, filed Oct. 25, 1982 now abandoned, there is disclosed in detail the desirability of utilizing elongated rotating fluid pressure chambers of maximum possible length in order to increase the amount of expansion, hence, cooling of the pressured gas produced by expansion of the gas in the elongated fluid pressure chamber. In all modifications disclosed in the aforesaid co-pending application, the effective length of the fluid pressure chamber is generally limited by the necessity of opening exhaust ports by the inward passage of the free piston toward the axis of rotation. Obviously, when the free piston passes such exhaust ports, it will be positioned proximate to the axis of rotation of the rotating elongated fluid pressure chamber, but cannot be permitted to pass beyond the axis of rotation because centrifugal force would then take over and move the piston radially away from the axis of rotation, leaving the exhaust ports open. Additionally, all of the modifications disclosed in the aforesaid co-pending application relied upon either a lower ambient pressure to pull the expanded gases out of the exhaust ports or the inlet suction produced by a compressor connected in the closed cycle versions of the apparatus. In effect the pistons were single acting, i.e., the fluid pressure was effective only in one direction.

It would obviously be desirable to provide rotating fluid pressure chambers of greater length, which can be accomplished by providing an S-shaped fluid pressure chamber extending diametrically from one side of the rotation axis to the other, provided that suitable valving arrangements are provided to permit the application of a pressured fluid at one end of the diametrically elongated fluid pressure chamber when the piston is adjacent that end and continue the application of such fluid pressure until the piston almost reaches the other end of the diametrically elongated fluid pressure chamber. Concurrently, the expanded exhaust fluid resulting from the previous stroke of the piston in the opposite direction can be positively displaced from the other diametrical end of the elongated fluid pressure chamber. Such an arrangement provides a maximum power input to the rotating body on which the diametrically elongated fluid pressure chamber is mounted.

On the other hand, when an optimum air cooling is desired, the valving arrangement should permit the application of a pressured fluid to the piston only for a sufficient period to insure that it will start to move inwardly from its radial outermost position, following which, the fluid pressure inlet is closed and the trapped charge of gas is expanded during most of the stroke of the piston through the diametrically extending S-shaped fluid pressure chamber.

A new charge of pressured gas may be introduced into the end of the S-shaped cylinder which the piston is approaching, and the exhaust valve closed prior to the piston reaching that end, in order to cushion the stopping movement of the piston and preventing it from impacting against the end of the cylinder. Alternatively, the closing of the exhaust valve may trap sufficient gas to absorb the kinetic energy of the piston, so the inlet valve opening can be delayed until the piston is stopped. Thus, a substantial portion of the kinetic energy of the piston is transmitted as a reaction force on the adjacent cylinder and wall to aid cylinder rotation, while the remaining energy is applied to the reverse stroke of the free piston. Obviously, when the reciprocating velocity of the free piston reaches a desired maximum, either the pressure or the amount of the successive pressured gas charges is reduced by conventional valving devices (not shown).

All of the foregoing objectives may be accomplished with the apparatus 1 schematically illustrated in FIG. 1. Such apparatus comprises a cylinder element 10 defining a generally S-shaped bore 10*a* which constitutes the fluid pressure chamber for the device. Cylinder element 10 is preferably mounted for rotation by a power drive shaft 2. For this purpose, the cylinder element 10 may be secured by a plurality of straps 12 to a circular plate 14 which in turn is suitably keyed or welded to the shaft 2. It is important that the end portions of cylinder element 10 be generally aligned with the direction of rotation.

On each end of the cylinder element 10 there are provided identical valving heads 20 which respectively include a solenoid operated pressure inlet valve 25 which controls the supply of pressured fluid from a supply conduit 25*a*. Additionally, valving head 20 includes a solenoid operated exhaust valve 26 which permits the exhausting of the fluid pressure chamber 10*a* into an exhaust conduit 26*a*.

A free piston 15 is mounted for reciprocal movement within the S-shaped fluid pressure chamber 10*a*. Such piston may comprise an ellipsoid-shaped piston, as illustrated, or it may comprise a ball. The detailed construction of such pistons are disclosed in my above referred to co-pending application. In any event, the free piston 15 is movable along the entire length of the S-shaped fluid pressure chamber 10*a* solely under the influence of fluid pressure forces and centrifugal force. Obviously, the centrifugal force operates in the opposite direction on the free piston 15 whenever it passes the axis of rotation of shaft 2.

To control the operation of the pair of solenoid inlet valves 25 and the pair of solenoid exhaust valves 26, it is necessary that the position of the free piston 15 in the S-shaped fluid pressure chamber 10*a* be detected. Accordingly, a plurality of electronic detecting devices are mounted in spaced relationship along the path of movement of free piston 15. Thus, two detecting devices 40*a* and 40*b* are respectively disposed adjacent the outer ends of the S-shaped fluid pressure chamber 10*a*, while two more detecting devices 40*c* and 40*d* are mounted adjacent the medial portions of the S-shaped fluid pressure chamber 10*a*.

Figure 2:
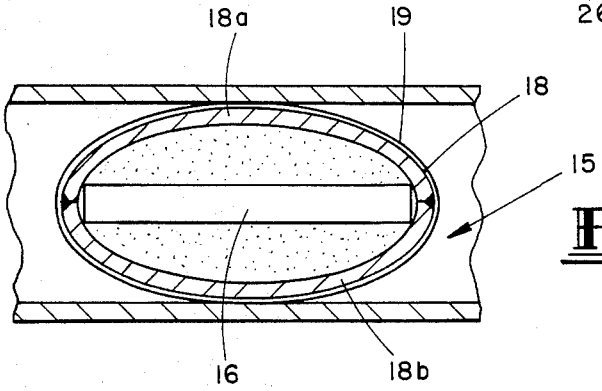
FIG. 2 is an enlarged scale sectional view of the free piston utilized in FIG. 1.

While the sensing devices 40 may incorporate either a conventional electrostatic or electromagnetic sensor, I preferably employ an electromagnetic sensor and a free piston 15 of ellipsoid configuration containing a permanent magnet 16 (FIG. 2) disposed in general alignment with the major axis of the ellipsoid piston. The remainder of the interior of the free piston 15 may be filled with any heavy non-ferrous metal 17, such as mercury or lead shot.

Piston 15 preferably comprises a thin-walled shell 18 formed by the welded assemblage of two stamped half portions 18*a* and 18*b*. The exterior ellipsoid surface of piston 15 is coated with an organic plastic material 19 having good lubricating and sealing properties, such as plastics sold under the Dupont trademarks "TEFLON" and "KALREZ".

Figure 3:
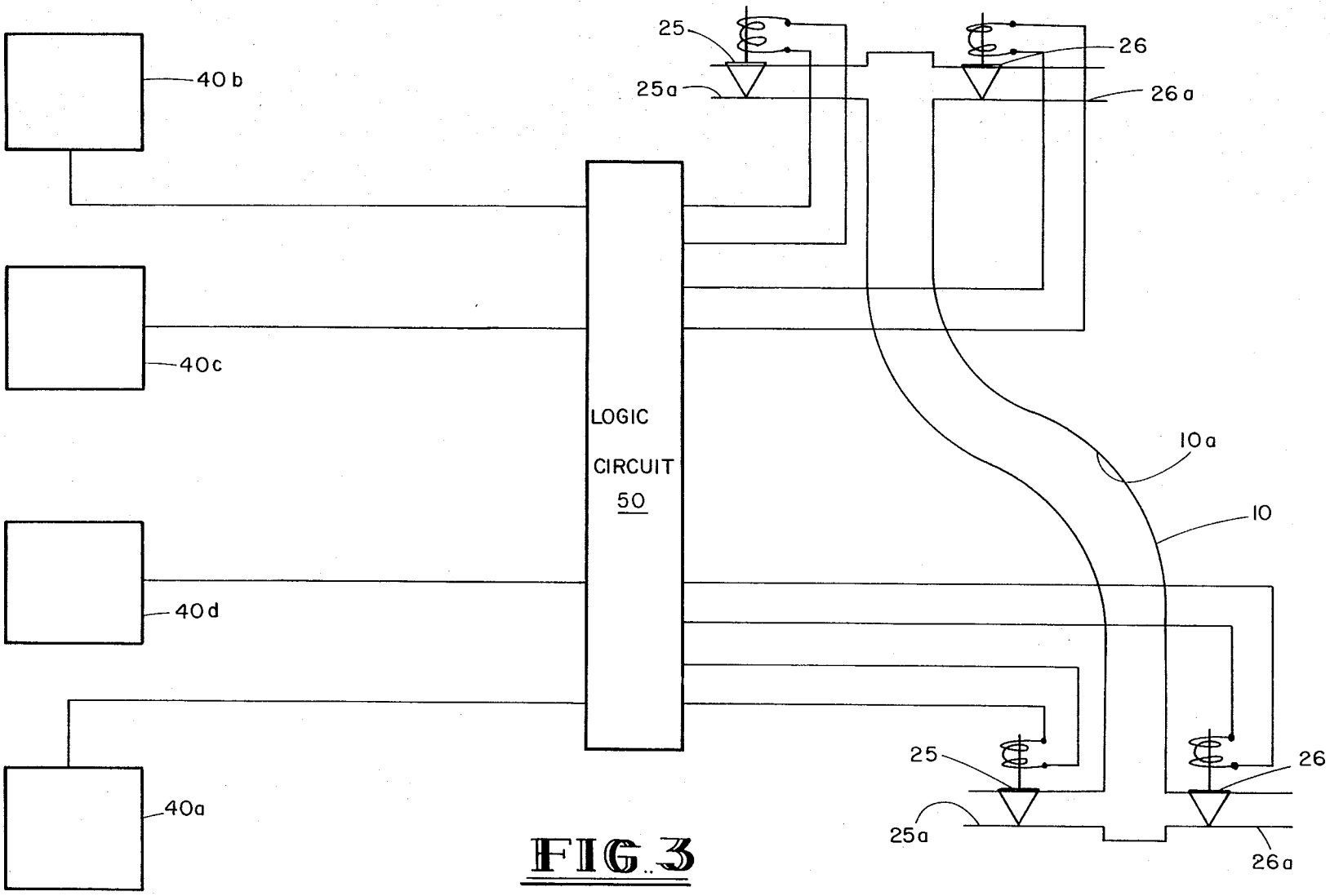
FIG. 3 is a schematic circuit diagram illustrating the control circuitry utilized in operating the apparatus of FIG. 1.

Referring now to FIG. 3, there is schematically indicated an electronic circuit for effecting the control of the solenoid valves 25 and 26 to effect the continuous reciprocation of the piston element 30 throughout the length of the S-shaped fluid pressure chamber 10*a*. The sensing devices 40*a*, 40*b*, 40*c* and 40*d* are connected through a logic circuit 50 to provide the required sequential operation of the solenoid operated inlet valves 25 and the solenoid operated exhaust valves 26 provided in each valving head 20 in accordance with the position of the free piston 15 in the fluid pressure chamber 10*a*. Thus, when the free piston 15 is adjacent the one diametrical end of the fluid pressure chamber 10*a* at which the sensing unit 40*a* is located, such sensing unit will operate through the logic circuit 50 to effect an opening of the adjacent pressured inlet valve 25 and a closing of the adjacent exhaust valve 26. Contemporaneously, the exhaust valve 26 at the opposite end of the fluid pressure chamber 10*a* will be opened. Accordingly, the free piston 15 will be driven inwardly by the charge of pressured gas and, if no other control functions were provided, the pressured gas would continue to be supplied to the piston 15 to drive it past the axis of rotation, at which point centrifugal force would become effective to urge it outward to the other extreme diametrical position. During all the time that the fluid pressure is acting on the free piston 15, a reaction force is being exerted by such fluid pressure against the end face of the fluid pressure chamber 10*a*, thus exerting a torque on the cylinder element 10 and the supporting body 14 to aid in maintaining or increasing the speed of rotation of such elements.

When the free piston 15 approaches the diametrically opposite end of the S-shaped fluid pressure chamber 10*a*, its presence will be picked up by detecting device 40*b* and the signal thus generated applied to the logic circuit 50 with the result that the fluid pressure inlet valve 25 adjacent the free piston will be opened and the exhaust valve 26 will be closed. This permits the applied fluid pressure to provide a cushioned stop for the movement of the piston 15 toward such opposite end and a substantial portion of the energy derived from such cushioned stop is applied in a direction to aid in rotating the cylinder 10 and hence the power shaft 2. In other words, a portion of the pressured gas energy is converted into kinetic energy of the piston which is transmitted to the cylinder head at the end of each piston stroke to increase the angular velocity of the cylinder 10 and shaft 2. The exhaust valve 26 at the opposite diametrical end of the S-shaped fluid pressure chamber 10*a* will be opened and the piston will reverse its movement through the S-shaped fluid pressure chamber 10*a*, thus functioning as a double acting free piston. Sensing unit 40*a* is again activated as the free piston approaches its original position thus repeating the cycle.

On the other hand, if it is desired to optimize the expansion of the pressure gas supplied to the fluid pressure chamber 10*a*, then the sensing devices 40*c* and 40*d* come into play. These devices respectively generate signals when the free piston 15 passes therethrough. Such sensing devices may be positioned adjacent the rotational axis shown, or radially spaced therefrom.

The sensing devices 40*c* and 40*d* are both connected to the logic circuit 50. Sensor 40*a* functions as previously described. The logic circuit 50 responds to the energization of pickup device 40*c* by closing the nearest fluid pressure inlet valve 25 which is supplying fluid pressure to the piston, thus, trapping the gas previously supplied behind the piston and permitting such gas to expand during the remainder of travel of the piston 30 to the opposite diametrical end of the S-shaped fluid pressure chamber 10*a*. Sensor 40*b* functions as previously described. The sensing device 40*d* is responsive to movement of the free piston 15 in the opposite direction to perform the same function as sensor 40*c*. Obviously, the permanent magnet 16 incorporated in the ellipsoid-shaped piston 15 produces an opposite signal in sensing devices 40*c* and 40*d* depending on the direction of movement of the free piston 15 with respect thereto, so that the reverse strokes of the free piston 15 have no effect.

Figure 4:
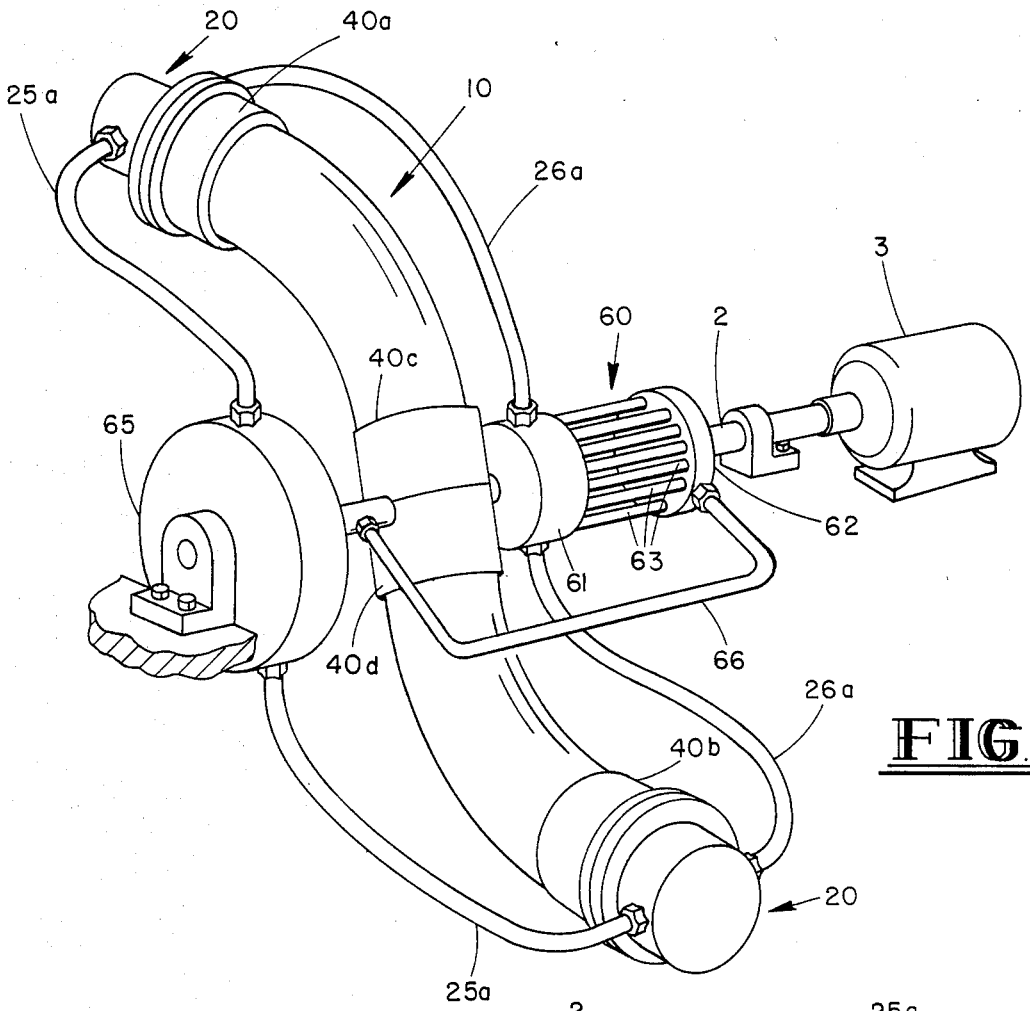
FIG. 4 is a schematic perspective view illustrating the utilization of the apparatus of FIG. 1 as an air conditioning mechanism.

The utilization of the cooled, expanded gases produced by the aforedescribed apparatus is accomplished in any of the manners illustrated in U.S. Pat. No. 4,420,944 issued Dec. 20, 1983. For example, as schematically shown in FIG. 4, the exhaust gas conduits 26*a* may be connected to an inlet header 61 of a rotating heat exchanger 60. The cooled gas is passed through axially extending tubes 63 into an outlet header 62 from whence it is returned by conduit 66 to the inlet of a compressor 65 which is co-rotatably driven with the power shaft 2, the cylinder element 10 and a driving motor 3. The pressured output of compressor 65 is supplied by conduits 25*a* which respectively connect to the solenoid controlled inlet valves 25. Thus, an efficiently operating closed-cycle air conditioning system may be based on the utilization of the S-shaped fluid pressure chamber 10*a*.

Figure 5:
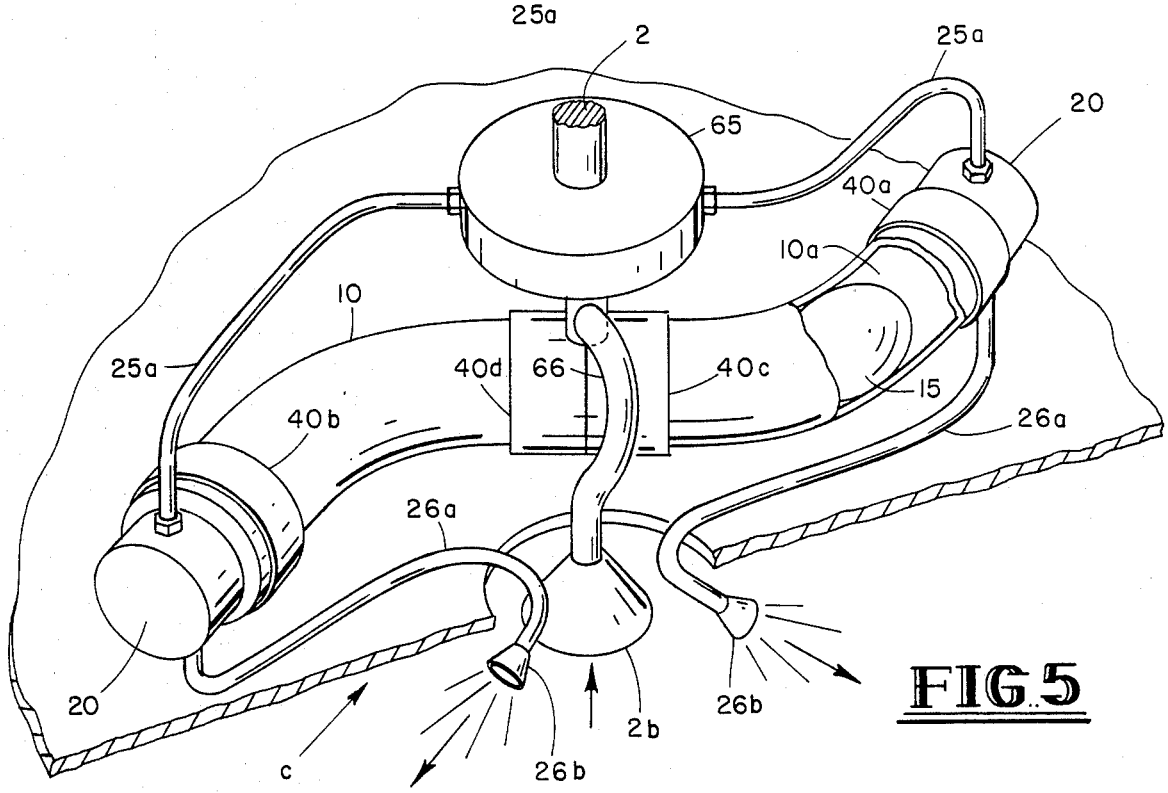
FIG. 5 is a schematic perspective view of an open cycle room cooling apparatus embodying the apparatus of FIG. 1.

Referring to FIG. 5, there is shown a further modification of this invention wherein a rotating S-shaped fluid pressure chamber is employed to supply cool air to a room or chamber in an open cycle system. As schematically illustrated in FIG. 5, the S-shaped cylinder 10, identical to that shown in FIG. 1, is mounted on a vertically positioned power shaft 2 and driven by a suitable motor (not shown). Cylinder 10 and a supporting plate (not shown) are both disposed above a ceiling C of a room to be cooled. Pressured air is supplied from a compressor 65 mounted on the upper end of shaft 2 through conduits 25*a* to the valving heads 20 provided at each end of the S-shaped cylinder 10. The cooled, expanded air is directed by exhaust conduits 26*a* through a suitable opening in the ceiling C to a pair of cone-shaped expanders 26*b* through which the cooled air is rotatingly discharged into the room. Re-circulation of the room air may be conducted through the hollow bore 2*a* of shaft 2 through a suitable conduit 66. Thus, the S-shaped fluid pressure chamber 10*a* and its cooperating ellipsoid free piston 15 may be advantageously employed in an open cycle room cooling system. The reaction forces on cylinder 10 contribute to maintenance of the rotation of shaft 2.

Figure 6:
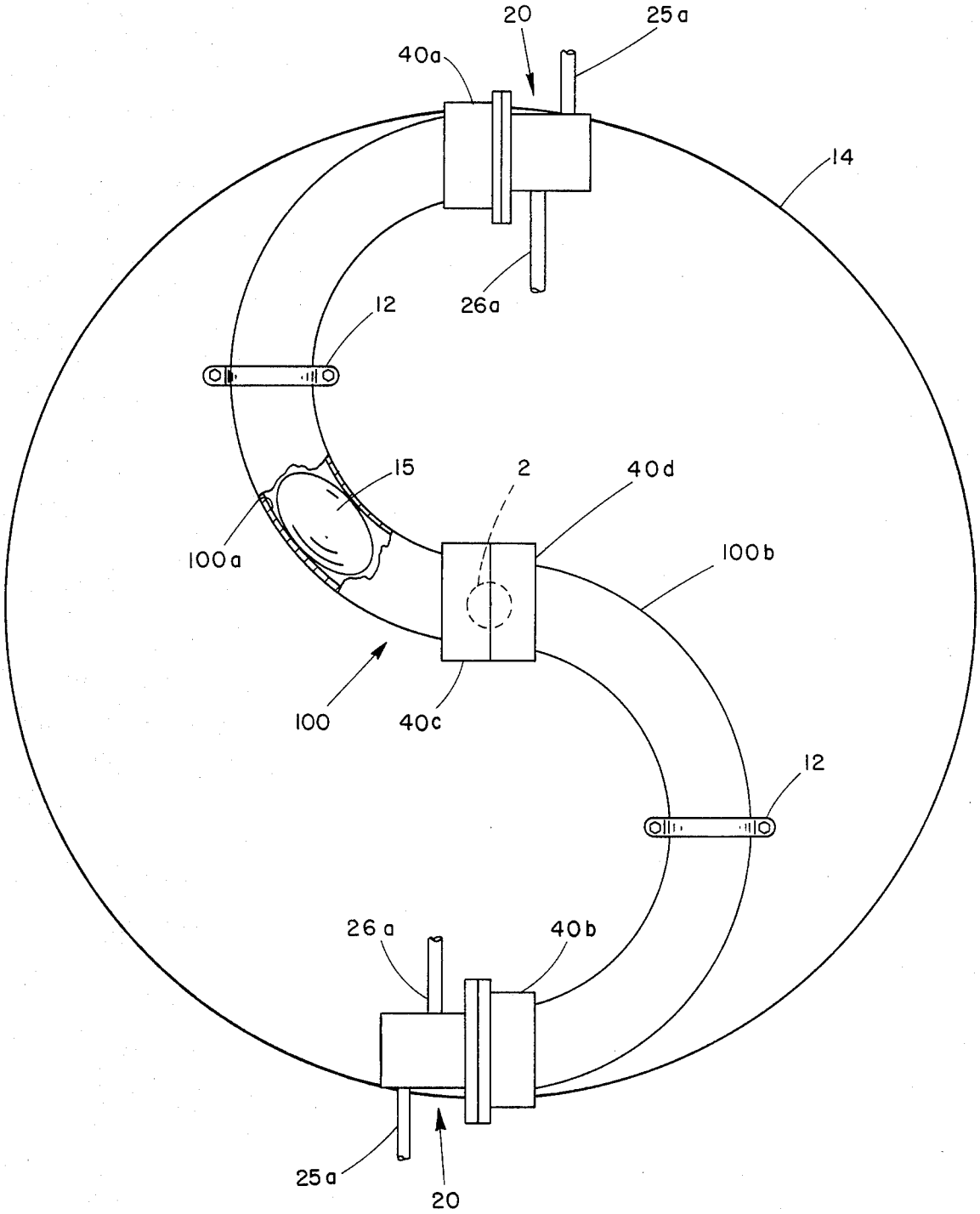
FIG. 6 is a schematic, elevational view of a modified form of S-shaped fluid pressure chamber.

Referring to FIG. 6, there is shown a modification of this invention wherein the S-shaped cylinder element 100 essentially comprises two semi-circular sections 100*a* and 100*b* which have their abutting ends located adjacent the rotation axis of shaft 2 and have valving heads 20, as previously described, secured to their diametrically opposed ends. The end portions of cylinder 100 are thus substantially aligned with the direction of rotation. The cylinder element 100 thus defines an S-shaped fluid pressure chamber 101 wherein the end walls of the fluid pressure chamber are both disposed in substantially radial planes with respect to the axis of rotation. This maximizes the torque arm available for the reaction force exerted by the expanding gas. Other elements of the apparatus are identical to those previously described in connection with the modification of FIG. 1, including the employment of an ellipsoid-shaped free piston 15 carrying a permanent magnet and the utilization of four sensing devices 40*a*, 40*b*, 40*c* and 40*d* to respectively control the pressure fluid inlet valves (not shown) and the solenoid control exhaust valves (not shown).

Figure 7:
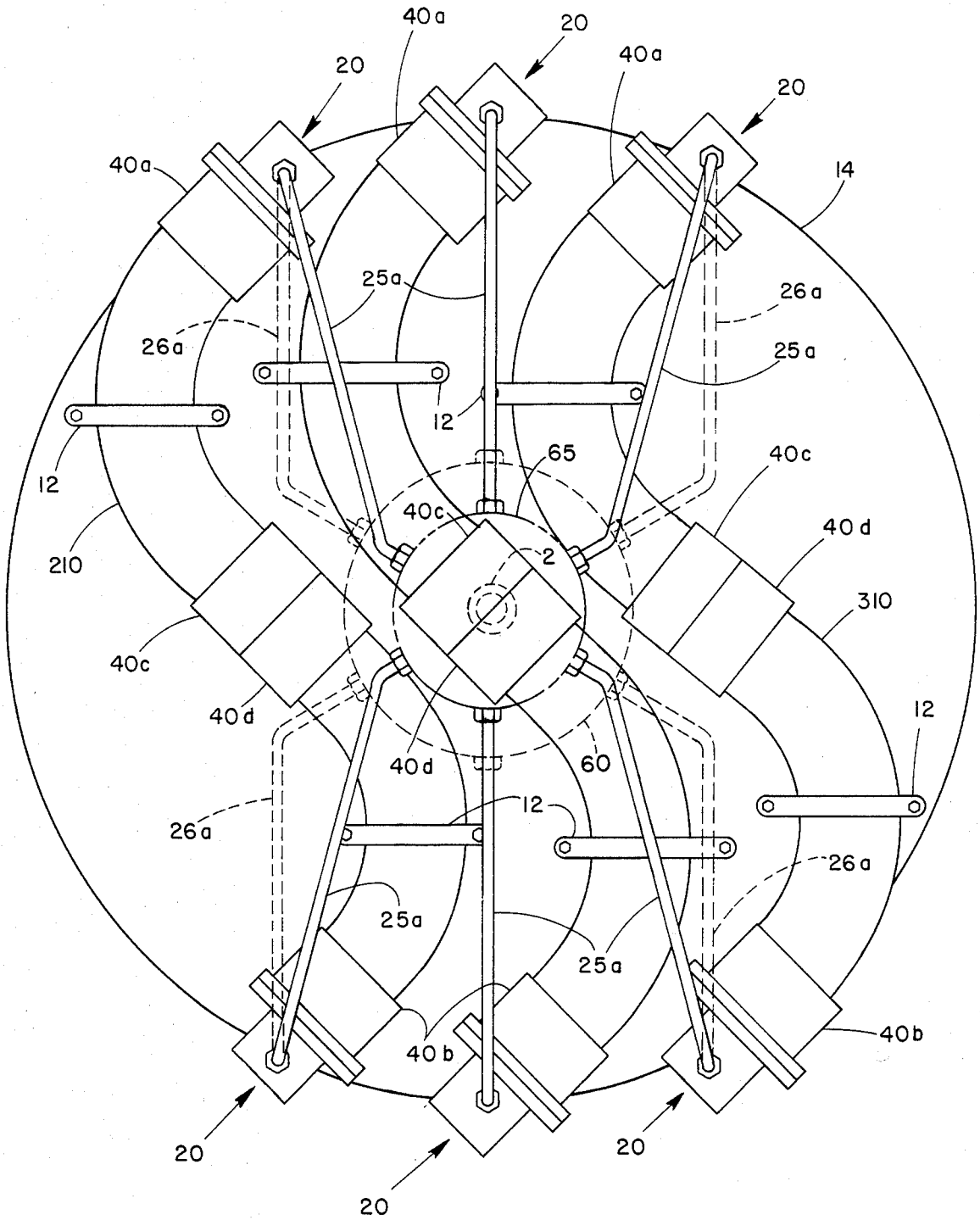
FIG. 7 is a schematic, elevational view illustrating the utilization of three S-shaped fluid pressure chambers mounted on a single rotating body.

Lastly, referring to FIG. 7, there is shown a further modificaton of this invention wherein an S-shaped cylinder element 10 identical to the modification of FIG. 1 is mounted on the rotatable plate 14 and two additional S-shaped cylinder elements 210 and 310 are respectively mounted on either side of the element 10. The cylinder elements 210 and 310 both incorporate S-shaped fluid pressure chambers, ellipsoid-shaped free pistons incorporating a permanent magnet (not shown), and valving heads 20 at each end of the cylinder elements 210 and 310, which perform the same functions as the valving heads 20 provided on the ends of the central S-shaped cylinder element 10. Piston sensing devices 40*a*, 40*b*, 40*c*, and 40*d* are also provided on these two additional S-shaped cylinder elements and these cooperate with the respective solenoid inlet and outlet valves in the valving heads 20 to control the reciprocal movement of the respective free pistons in the same manner as heretofore described. The exhaust conduits 15*a* may connect to a heat exchanger 60, and a compressor 65 on power shaft 2 supplies pressured gas to conduits 25*a*.

Alternatively, a plurality of single cylinder units similar to the modification of FIG. 1 may be mounted on the power shaft in axially stacked relationship.

As will be recognized by those skilled in the art, the aforedescribed arrangements present optimum length configurations for elongated rotating fluid pressure chambers within which a free piston is reciprocated solely through the action of pressure forces and centrifugal force. The control circuits provide an optimum of flexibility in selecting the type of cycle desired, according to the objectives set for the apparatus. Thus, the apparatus may be adjusted to produce a maximum extraction of mechanical energy from the pressured gas, thus functioning as a fluid pressure engine, or conversely, a maximum extraction of heat from the pressured gas to optimize the cooling action of the apparatus while still deriving mechanical energy from the pressured gas. Obviously, air may be employed as the pressured gas.

Those skilled in the art will recognize that any of the aforedescribed modifications of this invention may be utilized as a fluid pressure engine solely for the purpose of deriving mechanical energy from a source of pressured gas. For such application, the power drive motor 2 then essentially becomes a starting motor. The main function of the starting motor would be to impart sufficient rotation to the cylinder element 10 so as to insure that the free piston 15 is disposed in one of the outermost portions of the S-shaped fluid pressure chamber 10*a*. The application of fluid pressure to such one end of the S-shaped fluid pressure chamber 10*a* will cause the piston 15 to move radially inwardly in the manner heretofore described, thus imparting a reaction force on the end of the cylinder 10 to increase the speed of rotation of the cylinder element 10 and the drive shaft 2. When sufficient speed is obtained, the starting motor 2 may be disconnected or may be driven in an overspeed condition to function as a generator. Means other than a starting motor for assuring the initial positioning of the piston 15 in one of the remote ends of the S-shaped fluid pressure chamber 10*a* will be readily apparent to those skilled in the art.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for extracting heat and mechanical energy from a pressured gas comprising, in combination, a rotatable body; power means for rotating said body about a first axis; a cylinder means defining an elongated fluid pressure chamber having a generally S-shaped longitudinal axis; means for rigidly mounting said cylinder means on said body with the ends of said fluid pressure chamber disposed on opposite sides of said first axis and radially remote therefrom, and the central portions of said fluid pressure chamber proximate to said first axis; said fluid pressure chamber having a uniform cross-section throughout its length; a free piston mounted in said fluid pressure chamber for sliding sealable movement throughout the S-shaped length thereof, first and second valve means for respectively supplying pressured gas to the ends of said fluid pressure chamber; third and fourth valve means for respectively exhausting expanded gas from the ends of said fluid pressure chamber; and a plurality of piston detecting means spaced along the length of said cylinder means and operatively connected to said first, second, third, and fourth valve means to cause said piston to continuously reciprocate from one end to the other of said fluid pressure chamber as said body is rotated.

2. The apparatus of claim 1 wherein said free piston comprises a container filled with one of a class of heavy metals including lead and mercury.

3. The apparatus of claim 1 wherein said free piston is exteriorly coated with an organic plastic material having lubricating and sealing properties.

4. The apparatus of claim 1 wherein said piston detecting means are magnetically sensitive and said piston includes a permanent magnet.

5. The apparatus of claim 1 wherein said S-shaped fluid pressure chamber has a uniform circular cross-section and said piston comprises a sphere.

6. The apparatus of claim 1 wherein said S-shaped fluid pressure chamber has a uniform circular cross-section and said free piston comprises an ellipsoid having a minor axis diameter substantially equal to but less than the diameter of said fluid pressure chamber.

7. The apparatus of claims 1, 2, 3, 4, 5, or 6 wherein the end portions of said cylinder extend generally in the direction of rotation and diametrically opposed end walls of said S-shaped fluid pressure chamber are each positioned in a substantially radial plane relative to said axis of rotation.

8. The apparatus of claim 1, 2, 3, 4, 5, or 6 wherein two of said piston detecting means are respectively disposed adjacent the outermost ends of said S-shaped fluid pressure chamber and are respectively operative to open the adjacent one of said first and second valve means as said piston approaches one of the outermost ends of said S-shaped fluid pressure chamber.

9. The apparatus of claim 1, or 6 wherein two of said piston detecting means are respectively disposed adjacent the outermost ends of said S-shaped fluid pressure chamber and are respectively operative to open the adjacent one of said first and second valve means and the diametrically spaced one of said third and fourth valve means as said piston approaches one of the outermost ends of said S-shaped fluid pressure chamber, a third and fourth one of said piston detecting means being respectively disposed along the medial portion of said S-shaped fluid pressure chamber, said third piston detecting device being responsive to piston movement in one direction and said fourth piston detecting device being responsive to piston movement in the opposite direction to close the open one of said first and second valves to permit expansion of the pressured gas driving said piston.

10. An air cooling apparatus comprising, in combination, a rotatable body; power means for rotating said body about a first axis; a cylinder means defining an elongated fluid pressure chamber having a generally S-shaped longitudinal axis; means for rigidly mounting said cylinder means on said body with the ends of said fluid pressure chamber disposed on opposite sides of said first axis and radially remote therefrom, and the central portions of said fluid pressure chamber disposed proximate to said axis; said fluid pressure chamber having a uniform cross-section throughout its length; a free piston mounted in said fluid pressure chamber for sliding sealable movement through the S-shaped length thereof; first and second valve means for respectively supplying pressured air to the ends of said fluid pressure chamber; third and fourth valve means for respectively exhausting expanded air from the ends of said fluid pressure chamber, a plurality of piston detecting means spaced along the length of said cylinder means and operatively connected to said first, second, third, and fourth valve means to cause said piston to continuously reciprocate from one end to the other of said fluid pressure chamber as said body is rotated; and conduit means for connecting said third and fourth valve means to a chamber to be cooled.

11. The apparatus of claim 10 wherein said free piston comprises a container filled with one of a class of heavy metals including lead and mercury.

12. The apparatus of claim 10 wherein said free piston is exteriorly coated with an organic plastic material having lubricating and sealing properties.

13. The apparatus of claim 10 wherein said piston detecting means are magnetically sensitive and said piston includes a permanent magnet.

14. The apparatus of claim 10 wherein said S-shaped fluid pressure chamber has a uniform circular cross-section and said piston comprises a sphere.

15. The apparatus of claim 10 wherein said S-shaped fluid pressure chamber has a uniform circular cross-section and said free piston comprises an ellipsoid having a minor axis diameter substantially equal to but less than the diameter of said fluid pressure chamber.

16. The apparatus of claim 10 wherein the diametrically opposed end walls of said S-shaped fluid pressure chamber are each positioned in a substantially radial plane relative to said axis of rotation.

17. Air cooling apparatus comprising, in combination, a rotatable body; power means for rotating said body about a first axis; a cylinder means defining an elongated fluid pressure chamber having a generally S-shaped longitudinal axis; means for rigidly mounting said cylinder means on said body with the ends of said fluid pressure chamber disposed on opposite sides of said first axis and radially remote therefrom, and the central portions of said fluid pressure chamber disposed proximate to said first axis; said fluid pressure chamber having a uniform cross-section throughout its length, a free piston mounted in said fluid pressure chamber for sliding sealable movement throughout the S-shaped length thereof; first and second valve means for respectively supplying pressured air to the ends of said fluid pressure chamber; third and fourth valve means for respectively exhausting expanded gas from the ends of said fluid pressure chamber; and a plurality of piston detecting means spaced along the length of said cylinder means and operatively connected to said first, second, third and fourth valve means to cause said piston to continuously reciprocate from one end to the other of said fluid pressure chamber as said body is rotated; a compressor co-rotatable with said rotatable body; first conduit means connecting said third and fourth valve means to a room to be cooled; second conduit means connecting said room to the inlet of said compressor; and third conduit means connecting the outlet of said compressor to said first and second valve means to supply pressured air thereto.

18. Air cooling apparatus comprising, in combination, a rotatable body, power means for rotating said body about a first axis; a cylinder means defining an elongated fluid pressure chamber having a generally S-shaped longitudinal axis; means for rigidly mounting said cylinder means on said body with the ends of said fluid pressure chamber disposed on opposite sides of said first axis and radially remote therefrom, and the central portions of said fluid pressure chamber disposed proximate to said first axis; said fluid pressure chamber having a uniform cross-section throughout its length; a free piston mounted in said fluid pressure chamber for sliding sealable movement throughout the S-shaped length thereof; first and second valve means for respectively supplying pressured gas to the ends of said fluid pressure chamber; third and fourth valve means for respectively exhausting expanded gas from the ends of said fluid pressure chamber, and a plurality of piston detecting means spaced along the length of said cylinder means and operatively connected to said first, second, third, and fourth valve means to cause said piston to continuously reciprocate from one end to the other of said fluid pressure chamber as said body is rotated; a compressor co-rotatable with said rotatable body; a heat exchanger for cooling an air stream; and conduit means for directing expanded gas from said third and fourth valve means through said heat exchanger, to the inlet of said rotary compressor, and from the outlet of said rotary compressor to said first and second valve means.

19. The apparatus of claim 18 wherein said free piston comprises a container filled with one of a class of heavy metals including lead and mercury.

20. The apparatus of claim 18 wherein said free piston is exteriorly coated with an organic plastic material having lubricating and sealing properties.

21. The apparatus of claim 18 wherein said piston detecting means are magnetically sensitive and said piston includes a permanent magnet.

22. The apparatus of claim 18 wherein said S-shaped fluid pressure chamber has a uniform circular cross-section and said piston comprises a sphere.

23. The apparatus of claim 18 wherein said S-shaped fluid pressure chamber has a uniform circular cross-section and said free piston comprises an ellipsoid having a minor axis diameter substantially equal to but less than the diameter of said fluid pressure chamber.

24. The apparatus of claim 18 wherein the diametrically opposed end walls of said S-shaped fluid pressure chamber are each positioned in a substantially radial plane relative to said axis of rotation.

25. Apparatus for extracting heat and mechanical energy from a pressured gas comprising, in combination, a body rotatable about a first axis; a cylinder means defining an elongated fluid pressure chamber having a generally S-shaped longitudinal axis; means for rigidly mounting said cylinder means on said body with the ends of said fluid pressure chamber disposed on opposite sides of said first axis and radially remote therefrom, and the central portions of said fluid pressure chamber proximate to said first axis; a free piston mounted in said fluid pressure chamber for sliding sealable movement throughout the S-shaped length thereof; first and second valve means for respectively supplying pressured gas to the ends of said fluid pressure chamber; third and fourth valve means for respectively exhausting expanded gas from the ends of said fluid pressure chamber; and means responsive to the position of said piston in said fluid pressure chamber for controlling said first, second, third and fourth valve means to cause said piston to continuously reciprocate from one end to the other of said fluid pressure chamber and produce reaction forces on said cylinder to rotate said cylinder about said first axis.

26. The apparatus of claim 25 wherein said free piston comprises a container filled with one of a class of heavy metals including lead and mercury.

27. The apparatus of claim 25 wherein said free piston is exteriorly coated with an organic plastic material having lubricating and sealing properties.

28. The apparatus of claim 25 wherein said S-shaped fluid pressure chamber has a uniform circular cross-section and said piston comprises a sphere.

29. The apparatus of claim 25 wherein said S-shaped fluid pressure chamber has a uniform circular cross-section and said free piston comprises an ellipsoid having a minor axis diameter substantially equal to but less than the diameter of said fluid pressure chamber.

30. The apparatus of claims 25, 26, 27, 28 or 29 wherein the cylinder end portions extend generally in the direction of rotation and the diametrically opposed end walls of said S-shaped fluid pressure chamber are each positioned in a substantially radial plane relative to said axis of rotation.

31. Apparatus for extracting heat and mechanical energy from a pressured gas comprising, in combination, a body rotatable about a first axis; a cylinder means defining an elongated fluid pressure chamber having a generally S-shaped longitudinal axis; means for rigidly mounting said cylinder means on said body with the ends of said fluid pressure chamber disposed on opposite sides of said first axis and radially remote therefrom, and the central portions of said fluid pressure chamber proximate to said fist axis; a free piston mounted in said fluid pressure chamber for sliding sealable movement through the S-shaped length thereof; first and second valve means for respectively supplying pressured gas to the ends of said fluid pressure chamber; third and fourth valve means for respectively exhausting expanded gas from the ends of said fluid pressure chamber; and a plurality of piston detecting means spaced along the length of said cylinder means and operatively connected to said first, second, third and fourth valve means to cause said piston to continuously reciprocate from one end to the other of said fluid pressure chamber and produce reaction forces on said cylinder to rotate said cylinder about said first axis.

32. The apparatus of claim 31 wherein said free piston comprises a container filled with one of a class of heavy metals including lead and mercury.

33. The apparatus of claim 31 wherein said free piston is exteriorly coated with an organic plastic material having lubricating and sealing properties.

34. The apparatus of claim 31 wherein said piston detecting means are magnetically sensitive and said piston includes a permanent magnet.

35. The apparatus of claim 31 wherein said S-shaped fluid pressure chamber has a uniform circular cross-section and said piston comprises a sphere.

36. The apparatus of claim 31 wherein said S-shaped fluid pressure chamber has a uniform circular cross-section and said free piston comprises an ellipsoid having a minor axis diameter substantially equal to but less than the diameter of said fluid pressure chamber.

37. The apparatus of claim 31 wherein the ends of said cylinder extend generally in the direction of rotation and the diametrically opposed end walls of said S-shaped fluid pressure chamber are each positioned in a substantially radial plane relative to said axis of rotation.

38. The apparatus of claim 31 wherein two of said piston detecting means are respectively disposed adjacent the outermost ends of said S-shaped fluid pressure chamber and are respectively operative to open the adjacent one of said first and second valve means as said piston approaches one of the outermost ends of said S-shaped fluid pressure chamber.

39. The apparatus of claim 31 wherein two of said piston detecting means are respectively disposed adjacent the outermost ends of said S-shaped fluid pressure chamber and are respectively operative to open the adjacent one of said first and second valve means and the diametrically spaced one of said third and fourth valve means as said piston approaches one of the outermost ends of said S-shaped fluid pressure chamber, a third and fourth one of said piston detecting means being respectively disposed along the medial portion of said S-shaped fluid pressure chamber, said third piston detecting device being responsive to piston movement in one direction and said fourth piston detecting device being responsive to piston movement in the opposite direction to close the open one of said first and second valves to permit expansion of the pressured gas driving said piston.

40. The apparatus of claim 1, 10,, 17, 18, 25 or 31 wherein said S-shaped longitudinal axis of said fluid pressure chamber intersects said first axis.

41. The method of deriving mechanical energy from a pressured gas comprising the steps of:

(1) rotating by a separate motor a cylinder defining an S-shaped fluid pressure chamber about an axis transverse to the elongated axis of the chamber at its center;

(2) inserting a free piston element in the S-shaped fluid pressure chamber for slidable sealing movement therein;

(3) applying a valving head to each end of the cylinder, each said valving head having a power operated inlet valve and exhaust valve, and (4) opening the inlet valve to admit pressured fluid and closing the exhaust valve at one cylinder end and closing the inlet valve and opening the exhaust valve at the other cylinder end as the free piston approaches said one end, thereby producing a reciprocating movement of the free piston and a reaction force on the cylinder ends aiding the rotation thereof.

42. The method of expanding and cooling a pressured gas while deriving mechanical energy comprising the steps of:

(1) rotating by a separate motor a cylinder defining an S-shaped fluid pressure chamber about an axis transverse to the elongated axis of the chamber at its center;

(2) inserting a free piston element in the S-shaped fluid pressure chamber for slidable sealing movement therein;

(3) applying a valving head to each end of the cylinder, each said valving head having a power operated inlet valve and exhaust valve, (4) opening the inlet valve to admit pressured fluid and closing the exhaust valve at one cylinder end and closing the inlet valve and opening the exhaust valve at the other cylinder end as the free piston approaches said one end, thereby producing a reciprocating movement of the free piston and a reaction force on the cylinder ends aiding the rotation thereof;

(5) closing the opened inlet valve in one cylinder end after the free piston has moved a preselected distance toward the other cylinder end, thereby trapping fluid until the free piston approaches the other cylinder end.

43. The method of extracting mechanical energy from a pressured gas comprising:

(1) rotating a cylinder defining an S-shaped fluid pressure chamber about an axis transverse to and intersecting the center of the longitudinal axis of the S-shaped fluid pressure chamber with the opposed ends of said S-shaped fluid pressure chamber extending in the direction of rotation of said cylinder;

(2) permitting a free piston to slidably and sealably move in said S-shaped fluid pressure chamber;

(3) introducing pressured gas in said S-shaped fluid pressure chamber to impart kinetic energy to said piston to move toward one end of said S-shaped fluid pressure chamber while exerting a fluid pressure force on the other cylinder end to aid rotation of said cylinder; and (4) transmitting said kinetic energy of said piston to a charge of gas in said one end of said S-shaped fluid pressure chamber to further aid in rotation of said cylinder.

44. The method of extracting mechanical energy from a pressured gas comprising:

(1) rotating a cylinder defining an S-shaped fluid pressure chamber about an axis proximate and transverse to the center of the longitudinal axis of the S-shaped fluid pressure chamber with the opposed ends of said S-shaped fluid pressure chamber extending in the direction of rotation of said cylinder;

(2)l permitting a free piston to slidably and sealably move in said S-shaped fluid pressure chamber;

(3) introducing pressured gas in said S-shaped fluid pressure chamber to impart kinetic energy to said piston to move toward one end of said S-shaped fluid pressure chamber while exerting a fluid pressure force on the other cylinder end to aid rotation of said cylinder; and (4) transmitting said kinetic energy of said piston to a charge of gas in said one end of said S-shaped fluid pressure chamber to further aid in rotation of said cylinder.

* * * * *